United States Patent [19]

Yamada

[11] Patent Number: 4,655,581

[45] Date of Patent: Apr. 7, 1987

[54] COPYING APPARATUS

[75] Inventor: Yoshikado Yamada, Kashihara, Japan

[73] Assignee: Sharp Kabushiki Kaisha, Osaka, Japan

[21] Appl. No.: 741,883

[22] Filed: Jun. 6, 1985

[30] Foreign Application Priority Data

Jun. 11, 1984 [JP] Japan ..... 59-121008

[51] Int. Cl.[4] ..... G03G 21/00

[52] U.S. Cl. ..... 355/14 C; 355/15; 355/14 R; 250/559

[58] Field of Search ..... 355/15, 14 R, 14 C, 355/14 E, 3 R; 250/556, 559

[56] References Cited

U.S. PATENT DOCUMENTS

| | | | |
|---|---|---|---|
| 4,239,374 | 12/1980 | Tatsumi et al. | 355/14 E |
| 4,352,553 | 10/1982 | Hirahara | 355/14 E |
| 4,372,674 | 2/1983 | Yukawa | 355/14 E |
| 4,465,360 | 8/1984 | Yamagishi et al. | 355/15 X |
| 4,488,802 | 12/1984 | Sunaga et al. | 355/15 X |
| 4,564,287 | 1/1986 | Yamada | 355/14 E |
| 4,579,440 | 4/1986 | Katoh | 355/14 E |

*Primary Examiner*—R. L. Moses

*Attorney, Agent, or Firm*—Birch, Stewart, Kolasch & Birch

[57] ABSTRACT

A copying apparatus including a measuring device for measuring density of an image of an original document, a decision device for making a decision as to whether or not a measurement obtained by the measuring device is larger than a reference value, and a changeover device for changing over, on the basis of the decision made by the decision device, to one of a two-rotation process and a three-rotation process an operation for not only subjecting a photosensitive member to charge erasing but cleaning the photosensitive member such that the operation is performed once or twice during one copying operation in the two-rotation process and the three-rotation process, respectively.

8 Claims, 6 Drawing Figures

Output of slit sensor
PSW "ON"
1st rot.
2nd rot.
3rd. rot.
4th rot.
6 7 0 1
2 3
4 5 6 7 0 1
MMR
MHV
THV
DHV
PFS
TFC
MS1
MS2
MS3
CL
Output of light quantity sensor
Output of integrating circuit
Output of decision circuit
Ref. value PSW "ON"
1st rot.
2nd rot.
3rd rot.
4th rot.
5th. rot.
6701
23
4 5670l
Output of slit sensor
MMR
MHV
THV
DHV
PFS
TFC
MS1
MS2
MS3
CL
Output of light quantity sensor
Output of integrating circuit
Output of decision circuit
Ref. value

COPYING APPARATUS

BACKGROUND OF THE INVENTION

The present invention generally relates to copying apparatuses and more particularly, to a copying apparatus in which cleaning of a photosensitive member, i.e., an operation for removing residual toner from the surface of the photosensitive member is performed at a developing device.

Generally, in copying apparatuses, after a photosensitive member such as a photosensitive belt, etc. has been subjected to exposure and development such that a toner image on the photosensitive member is transferred onto a copy paper, a small amount of toner remains on the surface of the photosensitive member. In order to remove the residual toner from the surface of the photosensitive member, a cleaning electrostatic brush is applied to the surface of the photosensitive member after a residual electric charge has been eliminated from the surface of the photosensitive member by using a charge eraser, an eraser lamp, etc. Such a method has been widely employed in which an electrostatic brush for developing a latent image into the toner image through application of toner to the surface of the photosensitive member at a developing device functions also as the cleaning electrostatic brush in order to make the copying apparatuses compact in size and light in weight. This known method requires two rotations of the photosensitive member, i.e., one rotation for a developing process and the other for a cleaning process and therefore, is generally referred to as a "two-rotation process". However, when a high resistivity carrier such as a resin coat carrier, etc. is employed in place of a conventional iron powder carrier, the cleaning process does not work sufficiently. Thus, in order to meet a recent demand for copying of high image quality, there has been proposed a "three-rotation process" utilizing three rotations of the photosensitive member, i.e., one rotation for the developing process and the remaining two rotations for the cleaning process so as to perform the cleaning process twice such that residual toner is sufficiently removed from the surface of the photosensitive member. The prior art three-rotation process is advantageous in that residual toner is sufficiently removed from the surface of the photosensitive member. However, the known three-rotation process has such a drawback that since the photosensitive member is required to be rotated three times during one copying operation, the copying speed is undesirably low. Furthermore, the known three-rotation process has a disadvantage that when an original document has an image of a light shade, the first cleaning process suffices for removing residual toner from the surface of the photosensitive member, thereby making the second cleaning process useless.

SUMMARY OF THE INVENTION

Accordingly, an essential object of the present invention is to provide a copying apparatus which is arranged to automatically select one of a two-rotation process and a three-rotation process in accordance with the density of an image of an original document, with substantial elimination of the disadvantages inherent in conventional copying apparatuses of this kind.

In order to accomplish this object of the present invention, a copying apparatus embodying the present invention comprises a measuring means for measuring density of an image of an original document, a decision means for making a decision as to whether or not a measurement obtained by said measuring means is larger than a reference value; and a changeover means for changing over, on the basis of the decision made by the decision means, to one of a first process or a second process, an operation for not only subjecting a photosensitive member to charge erasing but cleaning the photosensitive member the that said operation is performed once or twice during one copying operation in the first process and the second process, respectively.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 4:
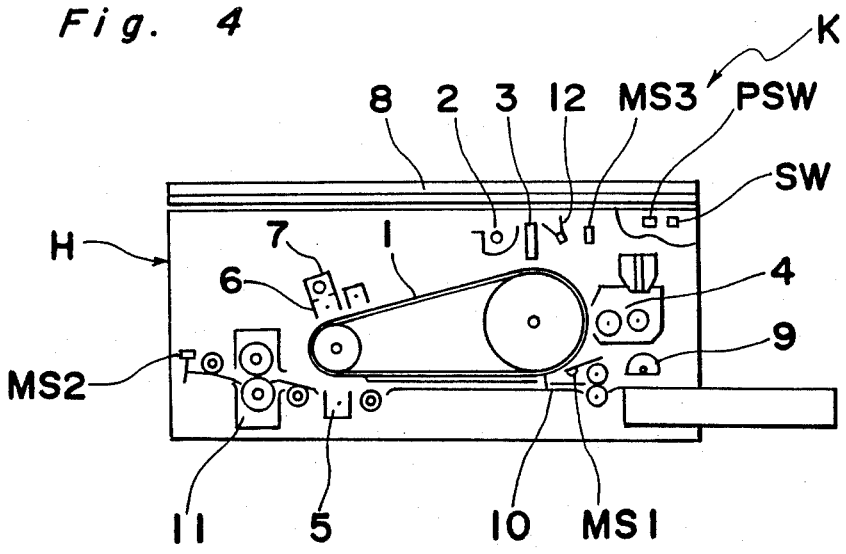
FIG. 4 is a schematic cross-sectional view of the copying apparatus of the present invention.

Referring now to the drawings, there is shown in FIG. 4, a copying apparatus K according to the present invention. The copying apparatus K includes a photosensitive belt 1 around which a developing device 4, a transfer charger 5, a charge eraser 6, and an eraser lamp 7, etc. are arranged in a known manner so as to be actuated synchronously with rotation of the photosensitive belt 1. Furthermore, an original platform 8 is supported by wheels (not shown) projecting upwardly from an upper face of an apparatus housing H of the copying apparatus K and is driven rightwards and leftwards by a driving device (not shown) upon turning on of a copy switch PSW. The copying apparatus K further includes an exposure lamp 2, an image transmitter 3 formed of a plurality of graded index fibers in a bundled configuration, and a light quantity sensor 12, which are disposed below the original platform 8. An original document placed on the original platform 8 is irradiated by the exposure lamp 2 and reflected light from the original document is transmitted to the photosensitive belt 1 by the image transmitter 3 such that an image of the original document is formed on the surface of the photosensitive belt 1. The light quantity sensor 12 receives a portion of the reflected light proceeding from the original document so as to measure its quantity of light. Meanwhile, a detection switch MS3 for detecting a stop position of the original platform 8 in a waiting state is provided adjacent to the driving device (not shown) for driving the original platform 8.

Moreover, the copying apparatus K includes a paper feeding roller 9 for feeding copy papers one sheet by one sheet, a stopper 10 for temporarily stopping feed of the copy paper, a detection switch MS1 for detecting the supply of copy paper and a detection the switch MS2 for detecting discharge of the copy paper, which are provided along a feed passage of the copy papers. Although not specifically shown, seven slits for controlling timing of actuation of the respective devices of the copying apparatus K are formed at a side portion of the photosensitive belt 1 and are constituted by an elongated reference slit having a starting end S7 and a terminal end S0 and six short slits S1, S2, S3, S4, S5 and S6 arranged sequentially from the terminal end S0. A slit sensor 15 (FIG. 5) detects the above described slits so as to control timing of actuation of the respective devices of the copying apparatus K. Meanwhile, the copy switch PSW is provided on an operating panel disposed on an outer face of the apparatus housing H.

Figure 5:
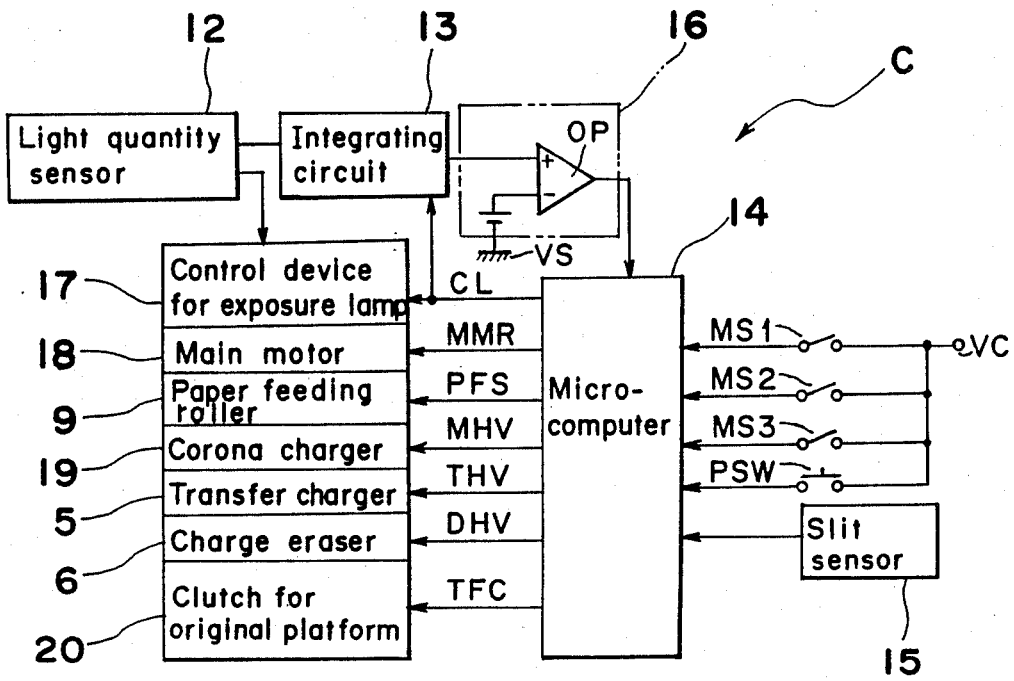
FIG. 5 is a block diagram of the control unit of FIG. 1.

Referring to FIG. 5, there is shown a control unit C employed in the copying apparatus K. The control unit C includes the light quantity sensor 12, an integrating circuit 13, a microcomputer 14, the slit sensor 15 and a decision circuit 16. The integrating circuit 13 is connected to the light quantity sensor 12 and integrates a measurement of the light quantity sensor 12 so as to supply its integrated value to the decision circuit 16. The decision circuit 16 includes an arithmetic amplifier OP and a power source VS for a reference voltage. The decision circuit 16 is arranged to yield an output "1" and an output "0" when the integrated value is more than and not more than the reference voltage, respectively. Namely, when density of the image of the original document is more than a predetermined value, the decision circuit 16 yields the output "1". On the other hand, when the density of the image of the original document is not more than the predetermined value, the decision circuit 16 yields the output "0". The output "1" or "0" is applied to the microcomputer 16. It is to be noted here that the light quantity sensor 12 and the integrating circuit 13 constitute a measuring means of the present invention and the decision circuit 16 corresponds to a decision means of the present invention.

The microcomputer 14 is connected to the copy switch PSW, slit sensor 15 and detection switches MS1, MS2 and MS3. In response to turning on and off of the respective switches and detection of the slits, the microcomputer 14 outputs seven kinds of control signals, i.e., a control signal CL for controlling a control device 17 for the exposure lamp 2, a control signal MMR for controlling a main motor 18, a control signal PFS for controlling the paper feeding roller 9, a control signal MHV for controlling a corona charger 19, a control signal THV for controlling the transfer charger 5, a control signal DHV for controlling the charge eraser 6 and the eraser lamp 7, and a control signal TFC for controlling a clutch 20 for driving the original platform 8.

Figure 1A:
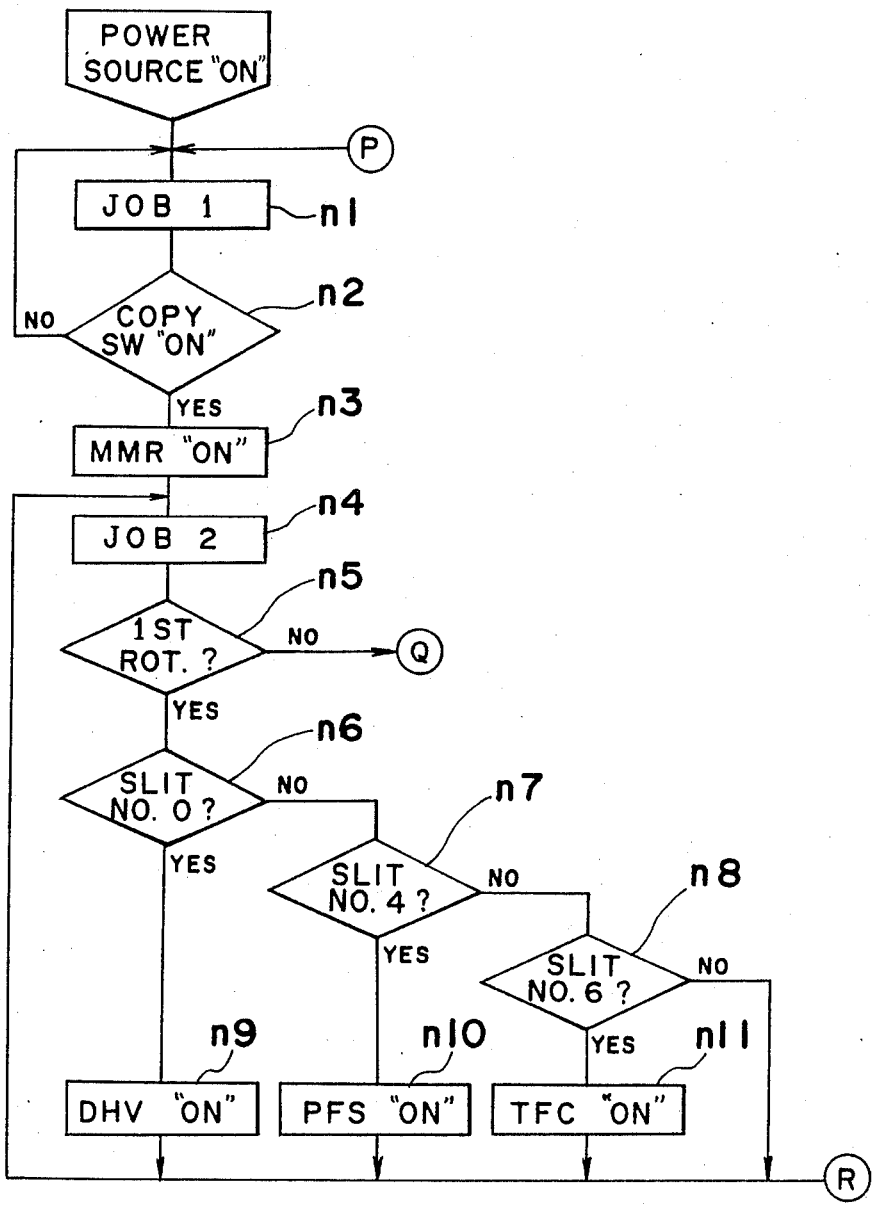
FIGS. 1*a* and 1*b* are flow charts showing a processing sequence of a control unit of a copying apparatus (FIG. 4) according to the present invention.
Figure 1B:
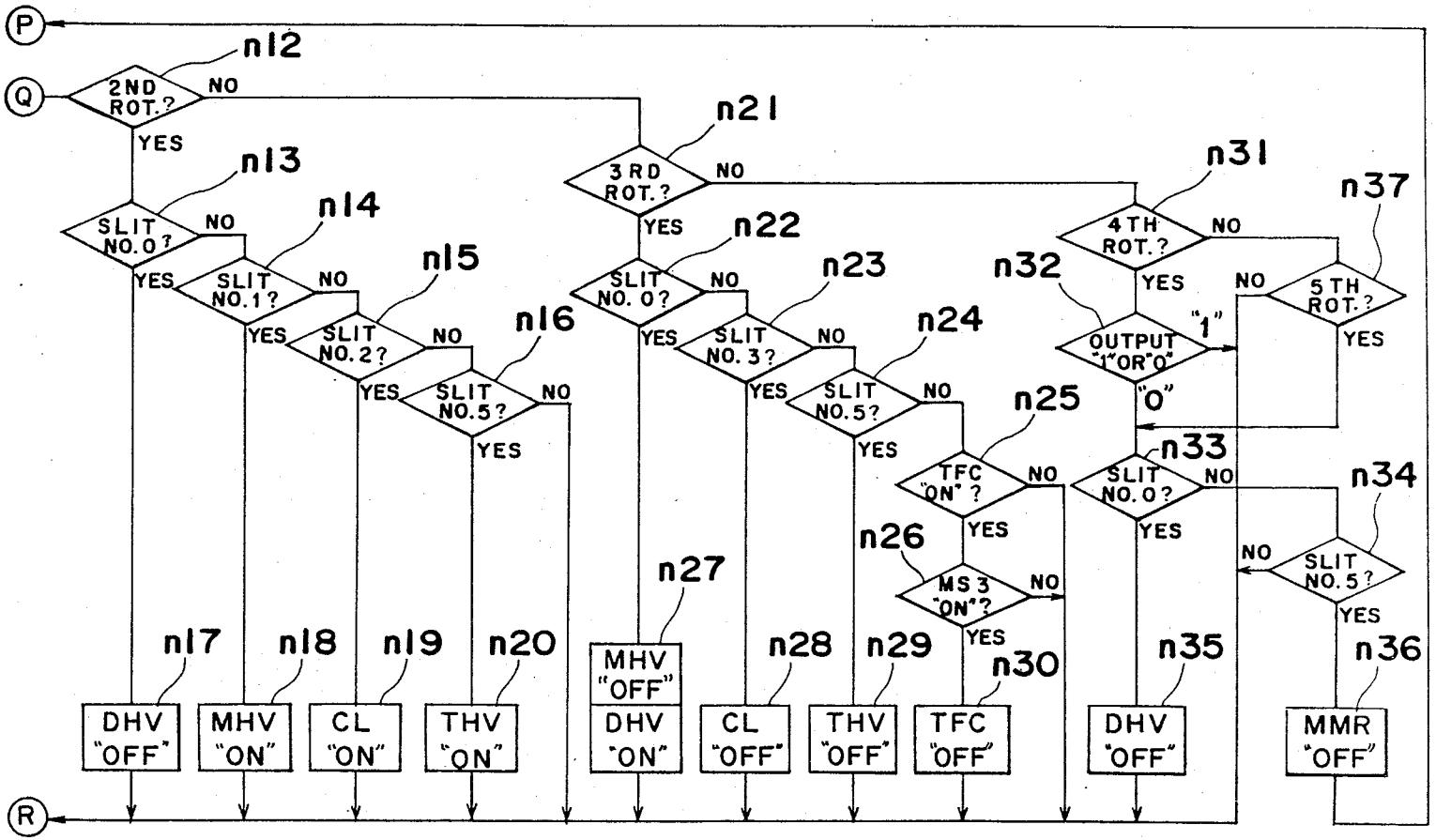
Figure 2:
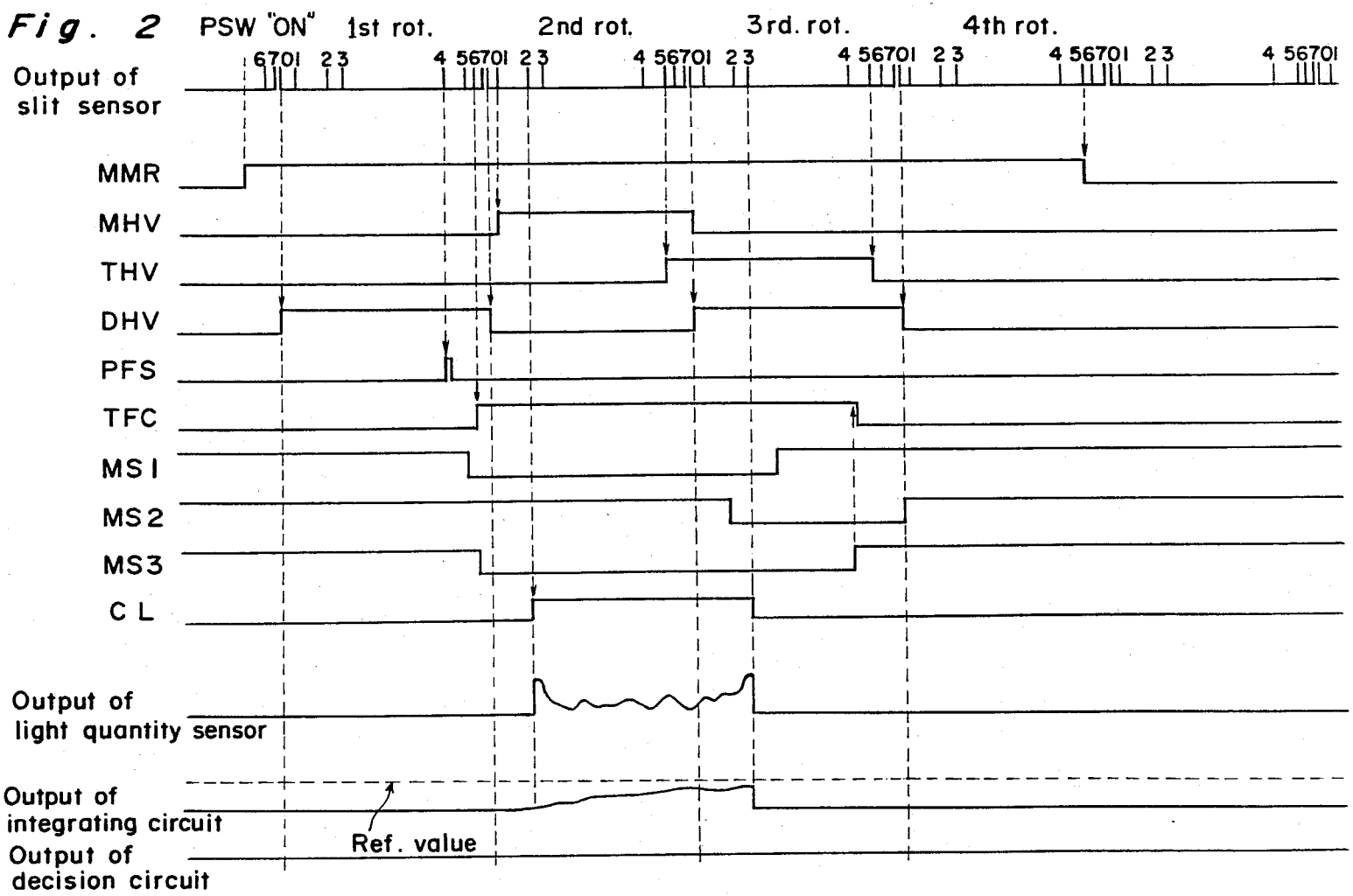
FIGS. 2 and 3 are time charts indicative of a two-rotation process and a three-rotation process of the copying apparatus of FIG. 4, respectively.
Figure 3:
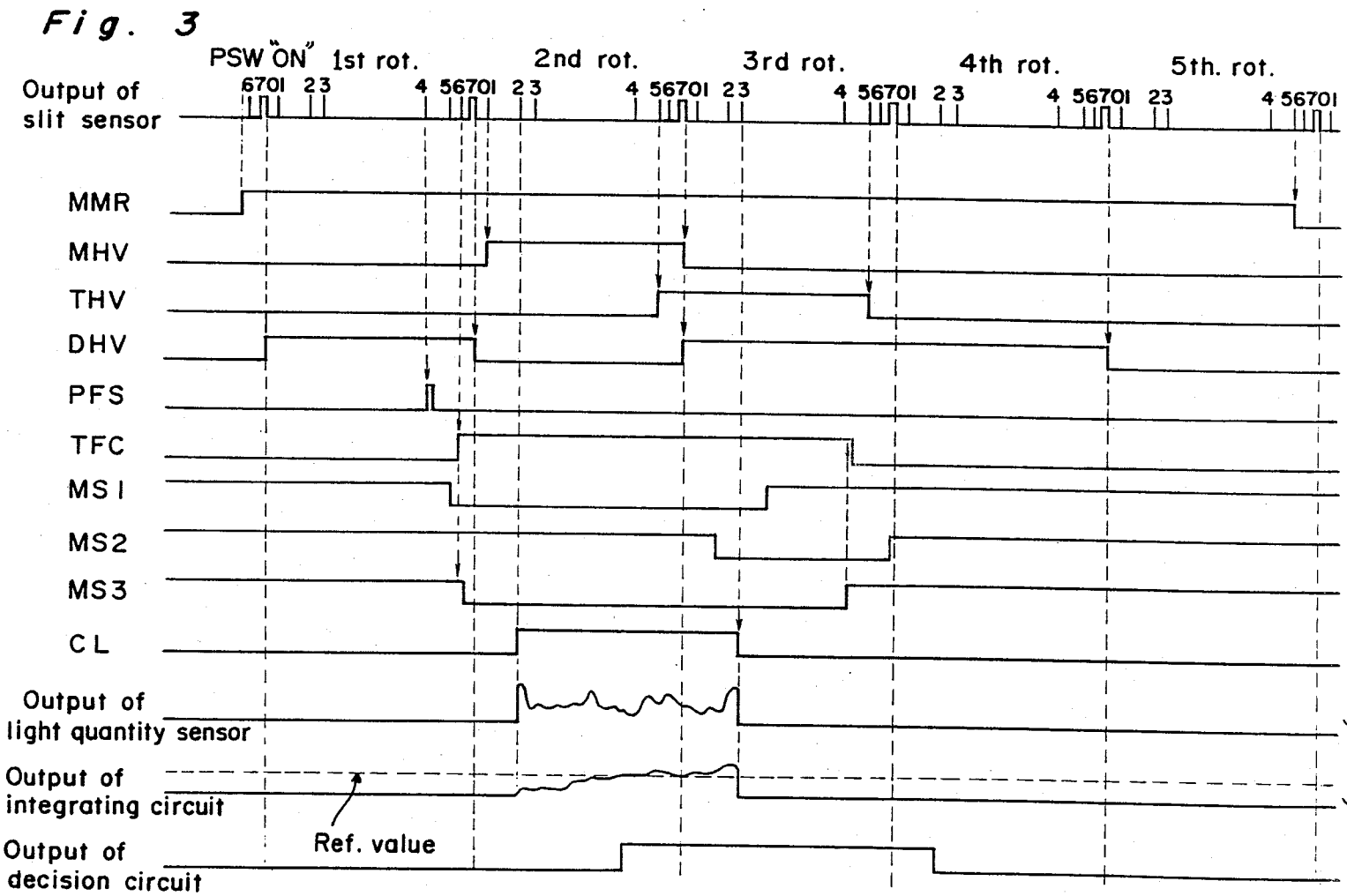

Hereinbelow, a processing sequence of the control unit C will be described with reference to flow charts of FIGS. 1*a* and 1*b*. When operation of the copying apparatus K has been started, displays on the operating panel, etc. are processed at step n1. Then, a decision is made at step n2 as to whether or not the copy switch PSW has been turned on. In the case of "NO" at step n2, the program flow returns to step n1. On the other hand, in the case of "YES" at step n2, the main motor 17 is driven at step n3 so as to start a copying operation. Thereafter, at step n4, operations necessary for performing the copying operation, for example, setting one of the displays of the operating panel to a copy mode are performed. Then, a decision is made at step n5 as to whether or not the photosensitive belt 1 is in the course of its first rotation. In the case of "YES" at step n5, step n6 follows. Meanwhile, in the case of "NO" at step n5, namely when the photosensitive belt 1 is in the course of its second or the subsequent rotation, step n12 follows. If it is found at steps n6, n7 and n8 that detection signals indicative of detection of the slits S0, S4 and S6 have been inputted to the microcomputer 14 by the slit sensor 15, respectively, steps n9, n10 and n11 follow, respectively. At steps n9, n10 and n11, the control signal DHV for controlling the charge eraser 6 and the eraser lamp 7, the control signal PFS for controlling the paper feeding roller 9, and the control signal TFC for controlling the clutch 20 for driving the original platform are energized, respectively. When the program flow returns to step n5 from step n11, the photosensitive belt 1 is brought into its second rotation and thus, step n12 follows. If it is found at step n12 that the photosensitive belt 1 is in the course of its second rotation, the program flow proceeds to step n13. If it is found at steps n13, n14, n15 and n16 that detection signals indicative of detection of the slits S0, S1, S2 and S5 have been inputted to the microcomputer 14 by the slit sensor 15, respectively, steps n17, n18, n19 and n20 follow, respectively. At step n17, the control signal DHV for controlling the charge eraser 6 and the eraser lamp 7 is deenergized. Meanwhile, at steps n18, n19 and n20, the control signal MHV for controlling the corona charger 19, the control signal CL for controlling the control device 17 for the exposure lamp 2, and the control signal THV for controlling the transfer charger 5 are energized, respectively. The image of the original document is copied onto the copy paper at steps n13 to n20. When the program flow returns to step n5 from step n20, the photosensitive belt 1 is brought into its third rotation and thus, the program flow proceeds to step n21 from step n5 via step n12. If it is found at step n21 that the photosensitive belt 1 is in the course of its third rotation, step n22 follows. If it is found at steps n22, n23 and n24 that detection signals indicative of detection of the slits S0, S3 and S5 have been inputted to the microcomputer 14 by the slit sensor 15, respectively, the program flow proceeds to steps n27, n28 and n29, respectively. At step n27, the control signal MHV for controlling the corona charger 19 is deenergized and the control signal DHV for controlling the charge eraser 6 and the eraser lamp 7 is energized. Meanwhile, at steps n28 and n29, the control signal CL for controlling the control device 17 for the exposure lamp 2 and the control signal THV for controlling the transfer charger 5 are deenergized, respectively. In the case of "NO" at step n24, step n25 follows. If it is found at step n25 that the control signal TFC for controlling the clutch 20 for driving the original platform 8 has been energized, a decision is made at step n26 as to whether or not the detection switch MS3 for detecting the stop position of the original platform 8 has been turned on. In the case of "YES" at step n26, the control signal TFC for controlling the clutch 20 for driving the original platform 8 is deenergized at step n30. During this third rotation of the photosensitive belt 1, the photosensitive belt 1 is cleaned. When the program flow returns to step n5 after steps n27 to n30 have been executed during the third rotation of the photosensitive belt 1, the program flow proceeds to step n31 through steps n12 and n21. If it is found at step n31 that the photosensitive belt 1 is in the course of its fourth rotation, step n32 follows where a decision is made as to whether the output of the decision circuit 16 is "1" or "0". In the case of "0" at step n32, step n33 follows so as to complete the copying operation. Meanwhile, in the case of "1" at step n32, the cleaning process to be performed during the third rotation of the photosensitive belt 1 is continued until the fourth rotation of the photosensitive belt 1 is completed. It should be noted that step n32 corresponds to a changeover means of the present invention for changing over the cleaning operation of the photosensitive belt 1 to one of a two-rotation process and a three-rotation process such that the cleaning operation is performed once during one copying operation in the two-rotation process and twice during the three-rotation process, respectively. If it is found at step n33 that the detection signal indicative of detection of the slit S0 has been applied to the microcomputer 14 by the slit sensor 15, step n35 follows where the control signal DHV for controlling the charge eraser 6 and the eraser lamp 7 is deenergized. In the case of "NO" at step n33, step n34 follows. If it is found at step n34 that the detection signal indicative of detection of the slit S5 has been applied to the microcomputer 14 by the slit sensor 15, step n36 follows where the control signal MMR for controlling the main motor 18 is deenergized. The program flow returns to step n1 from step n36 so as to set the copying apparatus K to the waiting mode for the next copying operation. In the case where the output of the decision circuit 16 is "1", the cleaning process is continuously performed also during the fourth rotation of the photosensitive belt 1 as described above. However, in the case of "NO" at step n31, namely when the photosensitive belt 1 is in the course of its fifth or the subsequent rotation, step n37 follows. If it is found at step n37 that the photosensitive belt 1 is in the course of its fifth rotation, step n33 follows. FIGS. 2 and 3 are time charts showing the two-rotation process and the three-rotation process of the copying apparatus K, respectively.

In the case where the copying operation is performed in the copying apparatus of the above described arrangement, the copying apparatus starts the copying operation through automatic exposure control by only turning on the copy switch after the copy paper has been placed on the original platform. Thereafter, the copying apparatus selects one of either the two-rotation process or the three-rotation process in accordance with density of the image of the original document so as to clean the photosensitive member either once or twice during the copying operation and then, stops its operation.

In accordance with the present invention, since the copying apparatus is arranged to automatically select one of either the three-rotation process for high image quality or the two-rotation process for high copying speed in accordance with density of the image of the original document, it becomes possible to secure both an excellent cleaning property of the photosensitive member and a high-speed copying operation.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A copying apparatus having a photosensitive member receiving a toner image wherein upon transfer of said toner image from said photosensitive member onto a copy paper, said photosensitive member is subjected to charge erasing and cleaning at a developing device, said copying apparatus comprising:

measuring means for measuring an image density of an original document;

decision means for determining whether or not a measurement obtained by said measuring means is larger than a reference value; and changeover means for switching, on the basis of said determination by said decision means, between either a first process or a second process for subjecting said photosensitive member to a charge erasing operation and a cleaning operation such that said cleaning operation is performed once during one copying cycle in said first process and at least twice during one copying cycle in said second process, respectively.

2. A copying apparatus as claimed in claim 1, wherein said measuring means includes a light quantity sensor for measuring a quantity of light reflected from said original document and an integrating circuit for integrating a measurement obtained by said light quantity sensor.

3. A copying apparatus as claimed in claim 1, wherein said decision means is a decision circuit including an arithmetic amplifier and a power source for a reference voltage.

4. A copying apparatus as claimed in claim 2, wherein said decision means is a decision circuit including an arithmetic amplifier and a power source for a reference voltage.

5. A copying apparatus as claimed in claim 1, wherein said changeover means is a microcomputer.

6. A copying apparatus as claimed in claim 4, wherein said changeover means is a microcomputer.

7. A copying apparatus as claimed in claim 1, wherein said first process includes at least two rotations of said photosensitive member, the first rotation being for initiating an operation including corona charging, developing, and transferring, and the second rotation being for initiating another operation including charge erasing and cleaning.

8. A copying apparatus as claimed in claim 1, wherein said second process includes at least three rotations of said photosensitive member, the first rotation being for initiating an operation including corona charging, developing, and transferring, the second rotation being for initiating another operation including charge erasing and cleaning, and the third rotation being for repeating said charge erasing and cleaning operation.

* * * * *